United States Patent [19]

Bailey

[11] 3,982,694

[45] Sept. 28, 1976

[54] ACCUMULATOR TYPE FUEL INJECTION ASSEMBLY

[75] Inventor: John M. Bailey, Dunlap, Ill.

[73] Assignee: Caterpillar Tractor Co., Peoria, Ill.

[22] Filed: Dec. 29, 1975

[21] Appl. No.: 645,054

[52] U.S. Cl. ..... 239/96; 239/533; 239/584

[51] Int. Cl.[2] ..... F02M 41/16; B05B 1/32

[58] Field of Search ..... 239/88–91, 239/453, 96, 533, 464, 584, 585

[56] References Cited

UNITED STATES PATENTS

| | | | |
|---|---|---|---|
| 2,063,709 | 12/1936 | Taylor | 239/453 |
| 2,556,369 | 6/1951 | Hogeman | 239/96 |
| 2,681,253 | 6/1954 | Hagelin et al. | 239/96 |
| 2,749,181 | 6/1956 | Maxwell et al. | 239/584 |
| 2,901,181 | 8/1959 | Bek | 239/533 X |
| 3,032,279 | 5/1962 | Czarnecki | 239/464 |
| 3,339,848 | 9/1967 | Geiger | 239/90 X |

FOREIGN PATENTS OR APPLICATIONS

| | | | |
|---|---|---|---|
| 552,873 | 2/1958 | Canada | 239/533 |
| 291,613 | 9/1953 | Switzerland | 239/533 |
| 584,616 | 1/1947 | United Kingdom | 239/584 |
| 633,857 | 12/1949 | United Kingdom | 239/533 |

*Primary Examiner*—Robert S. Ward, Jr.
*Attorney, Agent, or Firm*—Phillips, Moore, Weissenberger Lempio & Strabala

[57] ABSTRACT

A dual phase fuel injection nozzle assembly, including primary injection means which operate to provide a fine flow of fuel through an outward-opening check valve assembly and through a relatively small orifice. The assembly also includes secondary injection means which operate as an accumulator type fuel nozzle, utilizing a "non-return" valve to trap the fuel under pressure in an accumulator chamber and an inward-opening valve to control flow from the accumulator chamber through a relatively large orifice. The two phases are correlated with engine operating conditions to provide optimum rates of fuel injection over the entire operating range of a diesel engine.

19 Claims, 1 Drawing Figure

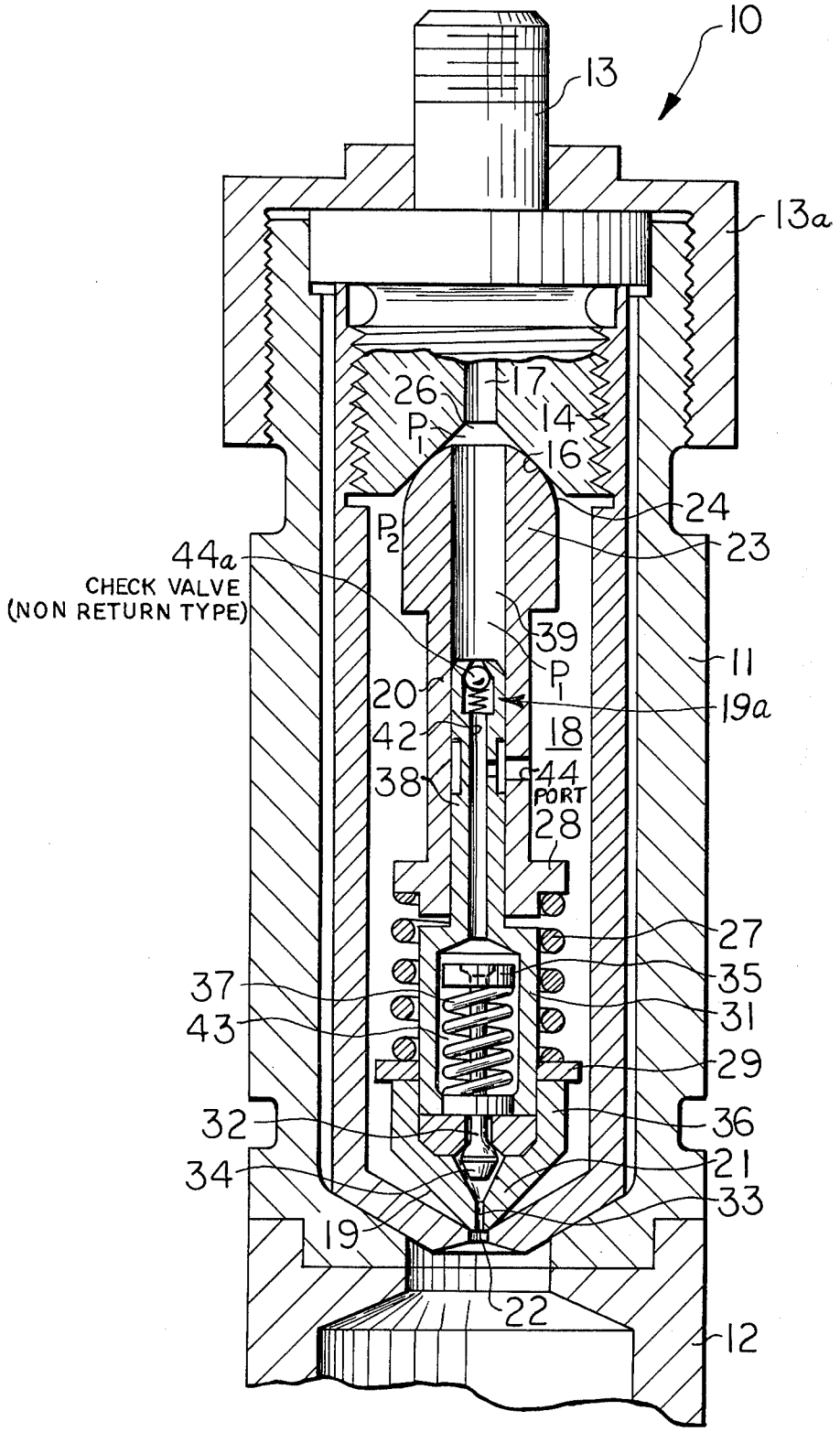
10
13
13a
26
17
14
P1
16
24
P2
23
44a
CHECK VALVE
(NON RETURN TYPE)
39
11
P1
20
19a
42
18
38
44
PORT
28
27
35
37
31
43
29
32
36
34
21
33
19
22
12

ACCUMULATOR TYPE FUEL INJECTION ASSEMBLY

BACKGROUND OF THE INVENTION

This invention relates to injection means for periodically injecting fuel into the combustion zone of an internal combustion engine. In particular, the invention relates to such injection means for dual phase fuel injection in a diesel engine wherein the fuel injection is correlated to engine load and speed.

Conventionally, in order to provide an optimal rate of fuel injection at high engine speeds and loads, a large injector orifice is required. Unfortunately, an orifice sufficiently large to provide high fuel injection rates when required cannot ordinarily provide the fuel atomization necessary during injection at low engine loads and speeds. As a result, at the lower engine loads and speeds fuel is incompletely burned and engine smoking difficulties are experienced. Also, under engine starting conditions, a finely atomized fuel spray is required. It is, therefore, usual for fuel injectors of the fixed-orifice type to have an orifice designed as a compromise between high and low engine load conditions to allow satisfactory engine operation in the major portion of the operating range. As is frequently the case with compromises, the results have not been completely satisfactory. Typically, engine performance at the extremes of the operating range has suffered from insufficiently high fuel injection rates at high load, high speed conditions and insufficient atomization at low load, low speed conditions.

Accumulator-type valves have been employed, particularly with engines having a high output, to obtain greater rates of fuel injection and shorter injection durations. Such accumulator-type injection means typically include a chamber in which fuel is trapped under pressure and then injected into the combustion zones of the engine at the desired time. By this means, very high rates of fuel injection with relatively short injection durations are obtainable. Such accumulator injection means are described, for example, in U.S. Pat. No. 2,985,378 to Falberg. Such accumulator-type injection means, however, are characterized by a high rate of injection at all engine speeds which rate is only minimally reduced as engine load is decreased. Excessive knock and peak cylinder pressure thereby result at low engine speeds. Additionally, the rate of injection is generally too high for optimum engine performance at low speeds.

It is, therefore, desirable to provide injection means utilizable for achieving varying fuel injection rates to provide optimum fuel injection for superior engine performance across the entire normal range of engine operating conditions.

SUMMARY AND OBJECTS OF THE INVENTION

The instant invention provides dual phase fuel injection means wherein the phased injection periods are correlated to engine speeds and loads. The injection means include accumulator chamber means for accumulating fuel under pressure, primary valve means for regulating fuel injection to the engine during a primary injection period, and accumulator valve means for regulating fuel injection from the accumulator chamber means to the engine during a secondary injection period. The primary injection phase is characterized by low rates of fuel injection and good fuel atomization for optimum starting and low speed, low load engine operation and the primary phase is predominant during such types of engine operation. The accumulator or secondary injection phase is characterized by high fuel injection rates, caused by the dissipation of energy stored in the accumulator chamber means, for optimum high speed, high load engine operation. Preferably, for high load operation, the two fuel injection phases overlap with the accumulator injection phase commencing prior to the termination of the primary injection phase to provide a relatively shorter total injection period and a single pressure rise in the engine cylinders. Alternatively, the fuel injection phases may be made to occur sequentially, with the accumulator injection phase discreetly following the primary injection phase. This type of operation, however, prolongs the combined injection period, and renders it longer than desirable for many applications.

It is, therefore, an object of the present invention to provide fuel injection means for internal combustion engines which improve engine performance over a wide range of operating conditions.

Another object of this invention is to provide dual-phase fuel injection means for internal combustion engines which provide a low rate of fuel injection for improved engine performance under low load, low speed conditions and during starting, and which provides a high rate of fuel injection for optimum engine performance under high load, high speed conditions.

It is a further object of this invention to provide dual-phase fuel injection means for internal combustion engines for improving atomization of the injected fuel whereby improved engine starting and improved low speed, low load engine performance is obtained.

Yet another object of this invention is to provide dual-phase fuel injection means for internal combustion engines having a high output whereby an increased fuel rate for such engines may be obtained without affecting the starting and low load performance of the engine.

It is an additional object of this invention to provide fuel injection means for internal combustion engines whereby improved injection rates for high speed, high load engine operation are obtained with a desirably short injection period.

Other objects and advantages of the invention will become apparent from the following description and drawing.

BRIEF DESCRIPTION OF THE DRAWING

The sole FIGURE is a longitudinal cross-sectional elevation of the fuel injection means of this invention, shown disposed in a precombustion chamber of a diesel engine.

DETAILED DESCRIPTION

The fuel injection means of this invention, generally indicated at 10, are illustrated disposed within an upper housing 11 of a precombustion chamber 12 of an internal combustion engine (not shown) for operative connection with a fuel pump assembly (not shown) via an adapter member 13 threadably secured by means of a retaining nut 13*a* to an injector casing 14. The adapter member 13 and the injector casing 14 comprise an assembly sealed against leakage. The adapter member is provided with an inner conical surface 16. The injection means 10 receives fuel in a conventional manner from the fuel pump assembly via a passage 17 in the adapter 13.

The injection means include an accumulator chamber 18 within the casing 14 for storing fuel under pressure and valve means, shown generally at 19, for regulating fuel flow from the accumulator chamber 18. Such valve means include a valve tip 21 for seating against a portion of the casing 14 to normally close off a relatively large orifice 22 therein.

Additional valve means, shown generally at 19*a*, include a body 20, a head portion 23, a port 44 and a check valve 44*a*. Check valve 44*a* is shown to be a reed-type valve. It should be understood, however, that other types of non-return valves such as a poppet valve may be used. Valve 44*a* functions to control the flow of fluid from a central passage 39, via the port 44 to the accumulator chamber 18.

A primary nozzle body 31 is provided with an extension portion 38 which fits within the valve body 20 with a slideable, sealing fit. Formed on an end of body 20 is a head portion 23 having a spherical surface 24 for seating against the inner conical surface 16 of the adapter member 13 to form an adapter chamber 26 therewith. Seating of the spherical surface 24 against the surface 16 provides self-alignment of valve tip 21 when it engages its seating portion of the casing 14.

The valve means 19 also includes spring means 27, biased between an annular shoulder 28 on the body 20 and a washer 29 which is circumferentially disposed upon a rearward portion of the valve tip 21 for urging the spherical surface 24 sealably against the surface 16 of the adapter 13 and for urging the valve tip 21 against its seat in the casing 14.

The primary nozzle body 31 encloses primary valve means, such as the check valve assembly 32, for regulating fuel flow through a relatively small orifice 33 in the valve tip 21. The check valve assembly 32 is suitable of the type described in U.S. Pat. No. 2,560,799 to Johnson, of common assignment herewith. The check valve assembly 32 includes a check valve 34 normally urged against a valve seat 36 by a check valve spring means 37 to normally block fuel flow through the orifice 33. The check valve assembly also includes a spring retainer 35 which transmits spring force to the check valve 34.

The extension portion 38 is slideably engaged within a passage 39 in the body 20 of the valve 19 and has a central bore 42 for fluid communication between the passage 39 and a nozzle chamber 43 in the nozzle body 31. The passage 39, bore 42, chamber 43 and orifice 33 thus comprise the primary injection channel for the injection means 10.

In the preferred embodiment, fuel is transmitted between the adapter chamber 26, wherein supply fluid is at a pressure $P_1$, and the passage 39 via the fuel port 44 through the wall of the body 20 which separates the passage 39 from the chamber 18. Valve 44*a*, normally closing port 44 when the injection means is non-operative, permits fuel to flow freely from passage 39 to accumulator chamber 18, but prevents backflow from chamber 18 to passage 39. That is, when the pressure of the fluid in chamber 18, $P_2$, is greater than pressure $P_1$, valve 44*a* closes and interdicts fluid flow from accumulator chamber 18 to the interior of the body 20.

OPERATION

In the preferred embodiment, upon the pressure stroke of the fuel pump plunger, fuel pressure is built up in adapter passage 17, adapter chamber 26 and passage 39. At a relatively low pressure level, valve 44*a* opens and charging of the accumulator chamber 18 commences. As fuel pressure in passage 39 builds up, pressure also increases in the connecting chamber 43 which is supplied through the passage 42. At a predetermined pressure level in chamber 43 fluid forces on the rear side of the valve 34 overcome the bias of the spring means 37 and the check valve 34 unseats to permit the injection of fuel into the precombustion chamber 12 via the orifice 33. This primary injection phase occurs concurrently with the charging of accumulator chamber 18.

The pumping stroke of the pump terminates shortly after fluid bypassing or spill occurs in such pumps. This causes a rapid pressure drop transmitted the length of the fuel line (between pump and fuel injection assembly 10) and to the chamber 26 which causes closure of the valve 44*a*. Actual closure of valve 44*a* occurs when $P_1$ (pressure in chamber 26) drops below $P_2$ (pressure in accumulator chamber 18).

When such valve is closed, high pressure fluid in the accumulator chamber 18 is trapped thus creating a store of energy in the form of compressed fuel. Immediately following the closing of valve 44*a*, the pressure of the fuel extant in the accumulator chamber, acting upon the differential area of the valve means 19, i.e. the projected area of the tip 21 versus the cross-sectional area of passage 39 minus that of the passage 42, causes valve tip 21 to lift from its seat and the secondary or accumulator phase of injection commences with fuel being discharged through the large orifice 22 into the precombustion chamber 12.

There is some overlap of the primary phase and the secondary phase of injection. The primary phase continues until the pressure of the fluid in chamber 43 decreases to a level which allows the check valve 34 to seat against valve seat 36. The secondary phase continues, after termination of the primary phase, until the pressure $P_2$, in the accumulator chamber, decreases to a level which allows valve tip 21 to seat against the casing 14, thus terminating the secondary injection phase.

When the primary phase of injection through the small orifice 33 occurs on each stroke of the supply pump, a finely atomized fuel spray is provided for starting and light engine load conditions. The secondary or accumulator phase may not occur (or is not predominant) at light engine loads but provides a great rate of injection through the large orifice 22, at the higher engine load conditions. Thus, at a high engine load condition, there is a blending of the primary and secondary phases to provide a total injection period of desirably short duration.

In view of the foregoing, it should be apparent that the present invention provides efficient improved fuel injection means for injecting fuel at the correct rate to afford optimum engine performance over the entire speed and load range and during starting.

While the invention has been described with particular reference to the preferred embodiments, it is apparent that variations and modifications are possible within the purview of the inventive concepts. No limitation with respect to such variations and modifications is intended, except those implicit in the scope of the appended claims.

I claim:

1. A two phase fluid injector means for supplying primary injection of fluid to a user device followed by a secondary injection of fluid to said device, said injector means comprising:

inlet means for receiving fluid under pressure from a source;

first chamber means for receiving fluid from said inlet means;

first outlet means for communicating fluid from said injector means to said device;

first valve means disposed between said first chamber means and said first outlet means for controlling the flow of fluid from said first chamber means to said first outlet means;

second outlet means for communicating fluid from said fluid injector means to said device;

accumulator chamber means disposed between said first chamber means and said second outlet means;

second valve means between said first chamber means and said accumulator chamber means for controlling the flow of fluid therebetween;

first biasing means for normally urging said first valve means to block the flow of fluid to said first outlet means, said second valve means including means for normally allowing flow of fluid from first chamber means to accumulator means and for normally blocking flow of fluid from accumulator chamber means to first chamber means;

third valve means disposed between said accumulator chamber means and said second outlet means; and biasing means normally urging said third valve means to close off communication between said accumulator chamber means and said second outlet means.

2. The invention of claim 1 wherein said second valve means include a second valve member for selectively providing free fluid flow through a port from said first chamber means to said accumulator chamber means but blocking fluid flow from said accumulator chamber means to said first chamber means.

3. The invention of claim 2 wherein said third valve means include a valve tip and a hollow extension portion attached to said tip, and further including an enlarged head portion having a hollow stem portion, said hollow extension portion being movably received at least partially within said hollow stem portion.

4. The invention of claim 3 wherein said first valve means is at least partially disposed within a part of said hollow extension portion, said port being disposed in said hollow stem portion.

5. The invention of claim 4 wherein said fluid injector means include an injector casing member, and wherein said first, second and third valve means and said accumulator means are each disposed within said casing member.

6. The invention of claim 5 wherein said second outlet means include an enlarged orifice in said casing member, said enlarged orifice being in constant communication with said device and with said first outlet means.

7. The invention of claim 6 wherein said valve tip is normally disposed to block fluid communication between said accumulator chamber and said enlarged orifice, said first outlet means including a small orifice in said valve tip.

8. A two phase fluid injector means for supplying primary injection of fluid to a user device following a secondary injection of fluid to said device, said injector means comprising:

inlet means for receiving fluid under pressure from a source;

first chamber means for receiving fluid from said inlet means;

first outlet means for communicating fluid from said injector means to said device;

first valve means disposed between said first chamber means and said first outlet means for controlling the flow of fluid from said first chamber means to said first outlet means;

second outlet means for communicating fluid from said fluid injector means to said device;

accumulator chamber means disposed between said first chamber means and said second outlet means;

second valve means between said first chamber means and said accumulator chamber means for controlling the flow of fluid therebetween;

first biasing means for normally urging said first valve means to block the flow of fluid to said first outlet means;

means in said second valve means for normally providing for free unidirectional flow of fuel from first chamber means to said accumulator chamber means while blocking reverse flow between said two chamber means;

third valve means disposed between said accumulator chamber means and said second outlet means;

other biasing means for normally urging said third valve means to close off communication between said accumulator chamber means and said second outlet means, said second valve means including a stem portion with a port therein for communicating fluid to said accumulator chamber means from the first chamber passage means.

9. The invention of claim 8 wherein said third valve means include a valve tip and a hollow extension portion attached to said tip, said hollow extension portion being movably received at least partially within a portion of said stem portion.

10. The invention of claim 9 wherein said first valve means is at least partially disposed within a part of said hollow extension portion.

11. The invention of claim 10 wherein said fluid injector means include an injector casing member, and wherein said first, second and third valve means and said accumulator chamber means are each disposed within said casing member.

12. The invention of claim 11 wherein said second outlet means include an enlarged orifice in said casing member, said enlarged orifice being in constant communication with said device and with said first outlet means.

13. The invention of claim 12 wherein said valve tip is normally disposed to block fluid communication between said accumulator chamber and said enlarged orifice, said first outlet means including a small orifice in said valve tip.

14. The invention of claim 13 wherein said first biasing means and other biasing means include coil springs.

15. The invention of claim 14 wherein said second coil spring is disposed between said stem portion and said valve tip for urging said stem portion away from said tip.

16. The invention of claim 13 wherein said first valve means include a check valve tip member and a spring retaininer connected together by means of an elongated shaft member, said first biasing means including a spring member disposed about said shaft member for normally urging said check valve tip member to a position in which it blocks the flow of fluid from said first chamber means to said small orifice.

17. The invention of claim 8 wherein said first valve means are disposed for moving to a first open position in which fluid flow between said first chamber means and said first outlet means is permitted prior to the movement of said third valve means to an open position in which fluid flow between said accumulator chamber means and said second outlet means is permitted.

18. The invention of claim 17 wherein said second valve means are disposed for movement to a position in which fluid flow from said first chamber means to said accumulator chamber means is permitted prior to movement of said third valve means to said open position and subsequently to movement of said first valve means to said first open position.

19. The invention of claim 10 wherein said fluid injector means include an injector casing member, and wherein said stem portion terminates in an enlarged head portion having a spherical surface thereon, said casing including an adapter portion having conical surface means thereon for engaging with said spherical surface to align said valve tip with respect to said second outlet means.

* * * * *